US010722809B1

(12) United States Patent
Park et al.

(10) Patent No.: US 10,722,809 B1
(45) Date of Patent: Jul. 28, 2020

(54) TOY BLOCK

(71) Applicant: GYMWORLD INC., Seoul (KR)

(72) Inventors: Kee Young Park, Seoul (KR); Gyu Jin Seo, Seoul (KR); Ju Seong Lee, Osan-si (KR); Chang Moon Lee, Gwangmyeong-si (KR); Ki Ho Lee, Hwaseong-si (KR); Yoon Su Cha, Suwon-si (KR); Na Young Go, Seongnam-si (KR); So Lee Kang, Seoul (KR); Jo Un Yi, Seoul (KR)

(73) Assignee: GYMWORLD INC., Seoul (KR)

( * ) Notice: Subject to any disclaimer, the term of this patent is extended or adjusted under 35 U.S.C. 154(b) by 0 days.

(21) Appl. No.: 16/436,751

(22) Filed: Jun. 10, 2019

(30) Foreign Application Priority Data

Jan. 29, 2019 (KR) ..... 10-2019-0011505

(51) Int. Cl.
*A63H 33/06* (2006.01)
*A63H 33/04* (2006.01)

(52) U.S. Cl.
CPC ..... *A63H 33/046* (2013.01)

(58) Field of Classification Search
CPC ..... A63H 33/46
USPC ..... 446/92; 273/239, 288
See application file for complete search history.

(56) References Cited

U.S. PATENT DOCUMENTS

| | | | | |
|---|---|---|---|---|
| 5,362,271 | A * | 11/1994 | Butt | A63H 3/36 446/129 |
| 6,352,463 | B2 * | 3/2002 | Forkman | A63H 17/264 213/75 D |
| 6,749,480 | B1 * | 6/2004 | Hunts | A63H 33/046 446/85 |
| 7,758,398 | B2 * | 7/2010 | Park | A63H 33/046 446/92 |
| 7,985,116 | B2 * | 7/2011 | Song | A63H 33/046 446/129 |
| 2004/0116038 | A1 * | 6/2004 | Hunts | A63H 33/046 446/92 |
| 2008/0305708 | A1 | 12/2008 | Toht | |
| 2009/0197500 | A1 * | 8/2009 | Song | A63H 33/046 446/92 |
| 2010/0120322 | A1 | 5/2010 | Vicentelli | |
| 2012/0309259 | A1 | 12/2012 | Mak | |

FOREIGN PATENT DOCUMENTS

| | | | |
|---|---|---|---|
| JP | H08-001387 | U | 9/1996 |
| JP | 2018-183679 | A | 11/2018 |
| KR | 10-1168139 | B1 | 7/2012 |
| KR | 10-2018-0044593 | A | 5/2018 |

* cited by examiner

*Primary Examiner* — Vishu K Mendiratta
(74) *Attorney, Agent, or Firm* — Korus Patent, LLC; Seong Il Jeong

(57) ABSTRACT

The present disclosure relates to a toy block, and the toy block includes a main body, a plate-shaped magnetic body located in an accommodation space in the main body and including a first surface and a second surface having different polarities, and a guide part disposed in the accommodation space and configured to guide rotation of the plate-shaped magnetic body.

4 Claims, 6 Drawing Sheets

TOY BLOCK

CROSS-REFERENCE TO RELATED APPLICATION

This application claims priority to and the benefit of Korean Patent Application No. 2019-0011505, filed on Jan. 29, 2019, the disclosure of which is incorporated herein by reference in its entirety.

BACKGROUND

1. Field of the Invention

The present disclosure relates to a toy block, and more particularly, to a toy block with which assembly is facilitated and applicable to various assemblies.

2. Discussion of Related Art

Toy blocks are blocks engaged with each other in various manners and thus capable of forming various shaped structures and are toys configured to improve ingenuity and spatial perceptions of children.

Since a general toy block includes an upper surface provided with a plurality of protrusions and a lower surface provided with a plurality of coupling grooves into which the protrusions can be inserted, an upper surface protrusion of one toy block is engaged with a lower surface coupling groove of another toy block and thus one toy block and another toy block are coupled to each other.

However, since the toy block in the above structure should have a protrusion part and a coupling groove each having a predetermined shape, a shape of the block is limited, and a spherical block cannot be used to assemble a structure since the spherical block cannot have the protrusion part and the coupling groove.

Meanwhile, toy blocks having a method of bonding to each other by magnetic forces of magnetic bodies by disposing the magnetic bodies at the outsides or the insides of the blocks, other than the above-described toy blocks, were developed. However, the toy blocks including the magnetic bodies are not coupled to each other when poles of the magnetic body are the same and are incorrectly coupled to each other when locations of the magnetic body are dislocated.

Accordingly, technologies for solving the above-described problems became necessary.

Meanwhile, the above-described related art is technical information possessed by an inventor to derive the present invention or acquired during a process of deriving the present invention and is not a known technology disclosed to the general public before the present invention is filed.

SUMMARY OF THE INVENTION

An embodiment of the present disclosure is directed to facilitate assembly and enable various shapes of blocks.

Further, an embodiment of the present disclosure is directed to guiding movement of a magnetic body to minimize a problem in which toy blocks are dislocated from each other when coupled to each other.

According to an aspect of the present disclosure, there is provided a toy block including a main body, a plate-shaped magnetic body located in an accommodation space in the main body and including a first surface and a second surface having different polarities, and a guide part disposed in the accommodation space and configured to guide rotation of the plate-shaped magnetic body.

The guide part may include a main guide extending to correspond to a rotating curved surface in a side surface of the plate-shaped magnetic body when the plate-shaped magnetic body rotates, and a sub guide extending in a direction different from an extending direction of the guide and having an extending surface parallel to the side surface of the plate-shaped magnetic body.

The base surface may correspond to a size of the first surface or the second surface of the plate-shaped magnetic body.

Each of the first surface and the second surface of the plate-shaped magnetic body may have a circular shape.

According to another aspect of the present disclosure, there is provided a toy block including a main body, guide parts located at each of one side and the other side of the main body and each including a base surface and at least one main guide extending in an arch shape with respect to the base surface, and plate-shaped magnetic bodies each configured to be rotatable along the main guide and in which polarities of both surfaces thereof are different from each other.

Each of the guide parts may further include a sub guide extending in a direction perpendicular to an extending direction of the main guide and in which an extending surface is connected to an extending surface of the main guide.

Each of both surfaces of each of the plate-shaped magnetic bodies may have a circular shape.

Each of the plate-shaped magnetic bodies may be configured to rotate along the main guide so that a surface having a polarity different from that of one surface of the other plate-shaped magnetic body seated on a base surface of other toy block which is to be coupled may come into contact with the base surface when the other toy block which is to be coupled approaches.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
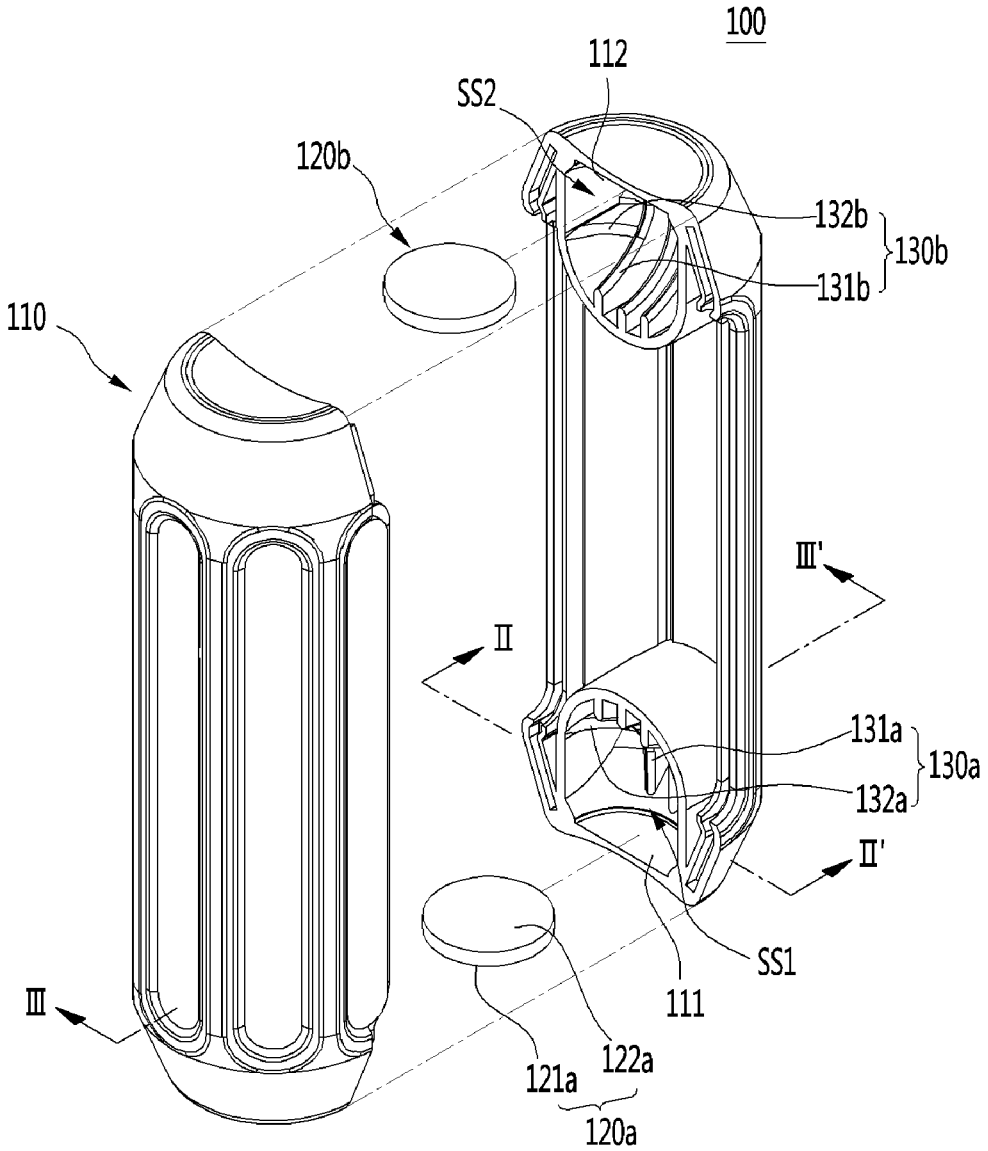
FIG. 1 is an exploded perspective view of a toy block according to an embodiment of the present disclosure.

Hereinafter, embodiments of the present disclosure will be described in detail with reference to the accompanying drawings so that those skilled in the art may easily perform the present disclosure. However, the present disclosure may be implemented in various forms and is not limited to the following embodiments. Components not related to the description are omitted in the drawings to clearly describe the present disclosure, and similar reference symbols are used for the same or similar components in the description.

In the description, in the case in which predetermined components are described as being "connected" to other components, the above case includes a case in which components are indirectly connected to other components through other members or elements. Further, in the case in which predetermined components are described as "including" predetermined elements, the above case does not exclude other elements but may further include the other elements unless otherwise defined.

Hereinafter, the present disclosure will be described in detail with reference to the accompanying drawings.

Figure 2:
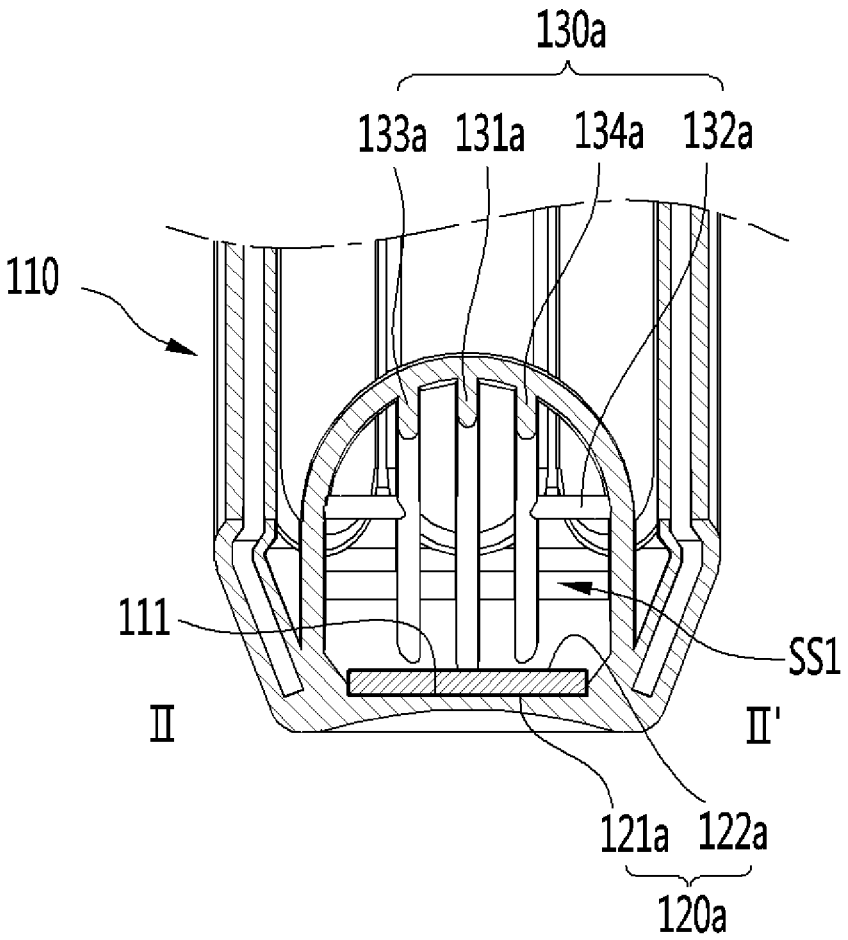
FIG. 2 is a cross-sectional view taken along line II-II' in FIG. 1.
Figure 3:
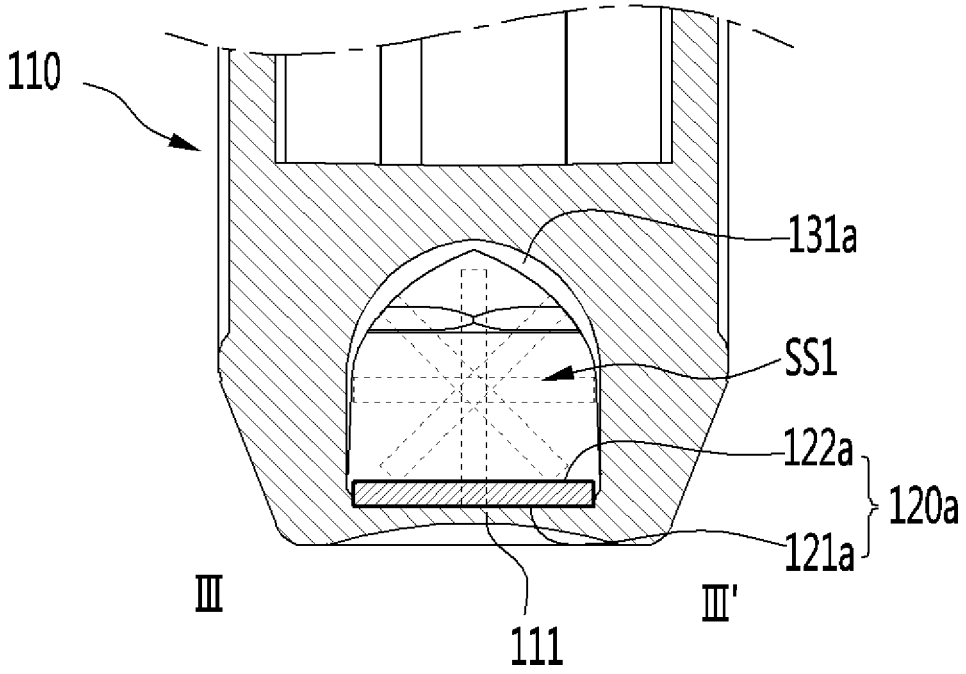
FIG. 3 is a cross-sectional view taken along line III-III' in FIG. 1.

FIG. 1 is an exploded perspective view of a toy block according to an embodiment of the present disclosure. FIG. 2 is a cross-sectional view taken along line II-II' in FIG. 1. FIG. 3 is a cross-sectional view taken along line III-III' in FIG. 1.

A toy block 100 according to an embodiment of the present disclosure may be a configuration piece of assembly toys that can be coupled to each other through a magnetic force.

Referring to FIG. 1, the toy block 100 according to the embodiment of the present disclosure may include a main body 110, plate-shaped magnetic bodies 120*a* and 120*b*, and guide parts 130*a* and 130*b*.

The main body 110 configures an exterior of the toy block 100 and includes base surfaces 111 and 112 on which plate-shaped magnetic bodies 120*a* and 120*b* are seated.

As shown in FIG. 1, the main body 110 may be configured in a pillar shape having a polygonal cross-sectional surface. However, the present disclosure is not limited thereto, and the main body 110 may be configured in various shapes such as a cylindrical shape, a hexahedron shape, a spherical shape, and the like and may also be configured in various shapes such as a curved shape, a donut shape, or the like that is not a pillar shape.

The main body 110 may be formed of nonmagnetic body material of which molding is facilitated and which is not magnetized by the plate-shaped magnetic bodies 120*a* and 120*b*. For example, the main body 110 may be formed of plastic, nonmagnetic metal, hardwood, or the like.

The base surfaces 111 and 112 of the main body 110 are surfaces on which first surfaces 121*a* or second surfaces 122*a* of the plate-shaped magnetic bodies 120*a* and 120*b* are seated, and have shapes corresponding to shapes of the first surfaces 121*a* or the second surfaces 122*a* of the plate-shaped magnetic bodies 120*a* and 120*b*. For example, as shown in FIG. 1, when each of the plate-shaped magnetic bodies 120*a* and 120*b* has a disk shape, each of the base surfaces 111 and 112 has a circular surface.

Further, the base surfaces 111 and 112 have sizes corresponding to sizes of the first surfaces 121*a* or the second surfaces 122*a* of the plate-shaped magnetic bodies 120*a* and 120*b*. For example, the base surfaces 111 and 112 have sizes which are substantially the same as the sizes of the first surfaces 121*a* or the second surfaces 122*a* of the plate-shaped magnetic bodies 120*a* and 120*b*. Here, the term "substantially the same sizes" may mean sizes the same as the sizes of the first surfaces 121*a* or the second surfaces 122*a* or sizes each having an outer circumferential side greater than an outer circumferential side of each of the first surfaces 121*a* or each of the second surfaces 122*a* within 0.5 mm.

As shown in FIG. 1, when the main body 110 is configured in the pillar shape, the base surfaces 111 and 112 are disposed at one side and the other side of main body 110, respectively.

Accommodation spaces SS1 and SS2 in which the plate-shaped magnetic bodies 120*a* and 120*b* are accommodated, respectively, are disposed with respect to the base surfaces 111 and 112. For example, a first accommodation space SS1 is formed with respect to the base surface 111 at the one side to surround the base surface 111 at the one side, and a first plate-shaped magnetic body 120*a* is disposed in the first accommodation space SS1. Further, a second accommodation space SS2 is formed with respect to the base surface 112 at the other side to surround the base surface 112 at the other side, and a second plate-shaped magnetic body 120*b* is disposed in the second accommodation space SS2. The accommodation spaces SS1 and SS2 may provide spaces sufficient to accommodate the plate-shaped magnetic bodies 120*a* and 120*b* and allow the plate-shaped magnetic bodies 120*a* and 120*b* to rotate, and the shape and arrangement of the accommodation spaces SS1 and SS2 may be freely deformed according to the design of the toy block 100.

The plate-shaped magnetic bodies 120*a* and 120*b* are configured to generate the magnetic force for coupling of the toy block 100, and the toy block 100 may be coupled to another block on the basis of the magnetic force of the plate-shaped magnetic bodies 120*a* and 120*b*. The plate-shaped magnetic bodies 120*a* and 120*b* may each include a permanent magnet permanently having a magnetic force or an electromagnet having an induction magnetic force by an electric current.

The plate-shaped magnetic bodies 120*a* and 120*b* are disposed in the accommodation spaces SS1 and SS2, respectively. For example, the first plate-shaped magnetic body 120*a* may be disposed in the first accommodation space SS1 and the second plate-shaped magnetic body 120*b* may be disposed in the second accommodation space SS2. In this case, the first accommodation space SS1 and the second accommodation space SS2 may be spaced apart from each other by a sufficient distance, and accordingly, magnetic force interference between the first plate-shaped magnetic body 120*a* and the second plate-shaped magnetic body 120*b* may be minimized.

Each of the plate-shaped magnetic bodies 120*a* and 120*b* has the first surface 121*a* and the second surface 122*a*. The first surface 121*a* and the second surface 122*a* of each of the plate-shaped magnetic bodies 120*a* and 120*b* have different polarities. For example, the first surface 121*a* may correspond to an N-pole and the second surface 122*a* may correspond to an S-pole.

As shown in FIG. 1, the first surfaces 121*a* and the second surfaces 122*a* of the plate-shaped magnetic bodies 120*a* and 120*b* each have a circular shape. However, the present disclosure is not limited thereto, and the first surfaces 121*a* and the second surfaces 122*a* of the plate-shaped magnetic bodies 120*a* and 120*b* may each include various shapes such as a polygonal shape, a trapezoidal shape, a fan shape, an elliptical shape, and the like.

The guide parts 130*a* and 130*b* are disposed in the accommodation spaces SS1 and SS2 in the main body 110, respectively, and configured to guide rotation of the plate-shaped magnetic bodies 120*a* and 120*b*.

The guide parts 130*a* and 130*b* include main guides 131*a* and 131*b* and sub guides 132*a* and 132*b*. The main guides 131*a* and 131*b* and the sub guides 132*a* and 132*b* are formed in structures configured to extend along inner surfaces of the accommodation spaces SS1 and the SS2. Specifically, the first accommodation space SS1 is formed to surround the base surface 111 at the one side, and a first main guide 131*a* and a first sub guide 132*a* extend along the inner surface of the first accommodation space SS1. Further, the second accommodation space SS2 is formed to surround the base surface 112 at the other side, and a second main guide 131*b* and a second sub guide 132*b* extend along the inner surface of the second accommodation space SS2. Since the first guide part 130*a* and the second guide part 130*b* differ only in their arrangement positions and have the same shape and configuration, hereinafter, the first guide part 130*a* will be mainly described with reference to FIGS. 2 and 3 together.

The first main guide 131*a* of the first guide part 130*a* extends to correspond to a rotating curved surface formed by a side surface of the plate-shaped magnetic body 120*a* when the plate-shaped magnetic body 120*a* rotates. Specifically, as shown in FIG. 3, the lower main guide 131*a* of the lower guide part 130*a* may extend in an arch shape with respect to the base surface 111. In this case, as shown in FIG. 2, the first main guide 131*a* may include a plurality of blades 131*a*, 133*a*, and 134*a* configured to protrude from the inner surface of the first accommodation space SS1 to extend in parallel.

In some embodiments, when each of the first surface 121*a* and the second surface 122*a* of the plate-shaped magnetic body 120*a* does not have a circular shape, since the rotating curved surface formed by the side surface of the plate-shaped magnetic body 120*a* when the plate-shaped magnetic body 120*a* rotates may become different, in this case, a shape of the first main guide 131*a* may be configured to be different from the shape shown in FIGS. 2 and 3.

The first sub guide 132*a* extends in a direction different from that of the first main guide 131*a* and extends in a direction parallel to the side surface of the plate-shaped magnetic body 120*a*. In this case, as shown in FIG. 2, an extending direction of the first sub guide 132*a* and an extending direction of the first main guide 131*a* may be perpendicular to each other. An extending surface of the first sub guide 132*a* is connected to an extending surface of the first main guide 131*a*. Accordingly, the first main guide 131*a* and the first sub guide 132*a* may be connected to each other without a step, and the plate-shaped magnetic body 120*a* may stably rotate along the extending surfaces of the first main guide 131*a* and the first sub guide 132*a*.

As described above, the toy block 100 according to the present disclosure includes the accommodation spaces SS1 and SS2, and the plate-shaped magnetic bodies 120*a* and 120*b* disposed in the accommodation spaces SS1 and SS2, respectively. Each of the plate-shaped magnetic bodies 120*a* and 120*b* includes the first surface 121*a* and the second surface 122*a* having different polarities, and the first surface 121*a* or the second surface 122*a* are configured to be seated on the base surfaces 111 and 112. Since the magnetic force of the plate-shaped magnetic bodies 120*a* and 120*b* is transferred to the outside of the main body 110 through the base surfaces 111 and 112, the toy block may be coupled to another toy block by the magnetic force. For a detailed description of the above, FIGS. 4 and 5 will be referenced.

Figure 4:
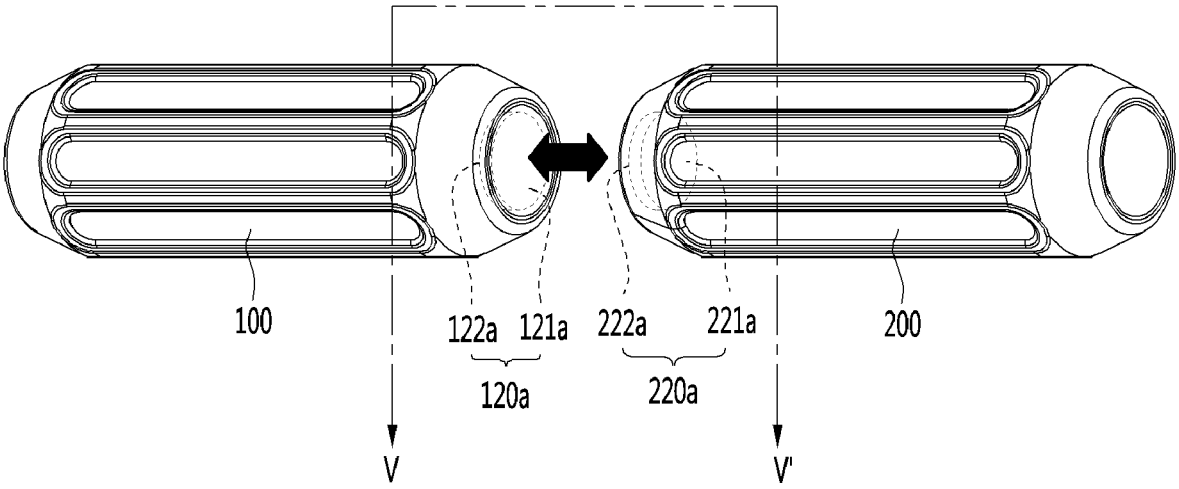
FIG. 4 is a use state view of toy blocks according to embodiments of the present disclosure.
Figure 5:
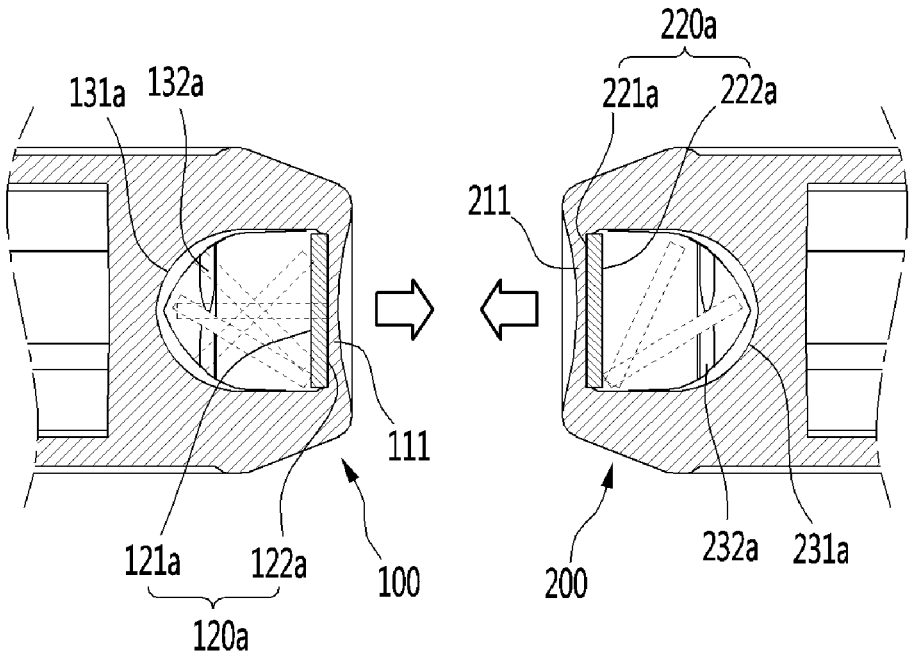
FIG. 5 is a cross-sectional view taken along line V-V' in FIG. 4.

FIG. 4 is a use state view of toy blocks according to embodiments of the present disclosure. FIG. 5 is a cross-sectional view taken along line V-V' in FIG. 4.

Referring to FIG. 4, a first toy block 100 may be coupled to a second toy block 200 adjacent thereto. Specifically, the first toy block 100 may be coupled to the second toy block 200 by magnetic attraction between the plate-shaped magnetic body 120*a* disposed in the accommodation space at one side of the first toy block 100 and a plate-shaped magnetic body 220*a* disposed in an accommodation space at another side of the second toy block 200. When the first surface 121*a* of the plate-shaped magnetic body 120*a* of the first toy block 100 and a second surface 222*a* of the plate-shaped magnetic body 220*a* of the second toy block 200 have different polarities, magnetic attraction acts between the first surface 121*a* of the plate-shaped magnetic body 120*a* of the first toy block 100 and the second surface 222*a* of the plate-shaped magnetic body 220*a* of the second toy block 200. Particularly, in this case, since the first surface 121*a* of the plate-shaped magnetic body 120*a* of the first toy block 100 and the second surface 222*a* of the plate-shaped magnetic body 220*a* of the second toy block 200 come into close contact with base surfaces to face each other in parallel, a magnetic flux passing through the plate-shaped magnetic bodies 120*a* and 220*a* may be maximized, and the magnetic attraction between the plate-shaped magnetic bodies 120*a* and 220*a* may be maximized. Accordingly, an upper portion of the first toy block 100 and a lower portion of the second toy block 200 may be strongly coupled to each other.

Meanwhile, when the first surface 121*a* of the plate-shaped magnetic body 120 of the first toy block 100 and the second surface 222*a* of the plate-shaped magnetic body 220*a* of the second toy block 200 have the same polarity, magnetic repulsion may be generated between the first surface 121*a* of the plate-shaped magnetic body 120 of the first toy block 100 and the second surface 222*a* of the plate-shaped magnetic body 220*a* of the second toy block 200. In this case, the plate-shaped magnetic body 120*a* of the first toy block 100 or the plate-shaped magnetic body 220*a* of the second toy block 200 rotates in the accommodation space so that the polarities of the plate-shaped magnetic body 120*a* of the first toy block 100 and the plate-shaped magnetic body 220*a* of the second toy block 200 become opposite to each other. For example, as shown in FIG. 5, the plate-shaped magnetic body 120*a* in the accommodation space at the one side of the first toy block 100 rotates, and thus the second surface 122*a* of the plate-shaped magnetic body 120*a* may come into contact with the base surface 111. Since the second surface 122*a* of the plate-shaped magnetic body 120*a* of the first toy block 100 has a polarity different from the second surface 222*a* of the second surface 222*a* of the plate-shaped magnetic body 220*a* of the second toy block 200, magnetic attraction acts between one end of the first toy block 100 and one end of the second toy block 200, and the first toy block 100 and the second toy block 200 may be coupled to each other.

In this case, as described above, the rotation of the plate-shaped magnetic body 120*a* is guided according to the guide part formed in the accommodation space of the first toy block 100 when the plate-shaped magnetic body 120*a* of the first toy block 100 rotates, and the first surface 121*a* or the second surface 122*a* of the plate-shaped magnetic body 120*a* may be stably seated on the base surface 111.

That is, as shown in FIG. 5, since the main guide 131*a* of the guide part extends in an arch shape with respect to the base surface 111 to correspond to the rotating curved surface in the side surface of the plate-shaped magnetic body 120*a*, the plate-shaped magnetic body 120*a* may rotate along the extending direction of the main guide 131*a* in a predetermined space, and the second surface 122*a* of the plate-shaped magnetic body 120*a* may be stably seated on the base surface 111. In FIG. 5, a rotating shape of the plate-shaped magnetic body 120*a* is shown as a dotted line.

Meanwhile, since the sub guide 132*a* of the guide part 130*a* extends to be parallel to the side surface of the plate-shaped magnetic body 120*a*, separation of the plate-shaped magnetic body 120*a* in a lateral direction may be restricted when the plate-shaped magnetic body 120*a* rotates, and accordingly, the second surface 122*a* of the plate-shaped magnetic body 120*a* may be more stably seated on the base surface 111.

Further, the plate-shaped magnetic body 220*a* in the accommodation space at the other side of the second toy block 200 rotates so that the second surface 222*a* is seated on a base surface 211. That is, the plate-shaped magnetic body 220*a* inclined by gravity rotates due to the magnetic attraction with the plate-shaped magnetic body 120*a* of the first toy block 100. In FIG. 5, a rotating shape of the plate-shaped magnetic body 220*a* is shown as a dotted line. In this case, a main guide 231*a* and a sub guide 232*a* of the second toy block 200 guide rotation of the plate-shaped magnetic body 220*a*. Accordingly, the second surface 222*a* of the plate-shaped magnetic body 220*a* is stably seated on the base surface 211 of the second toy block 200.

Accordingly, since the first toy block 100 and the second toy block 200 become close to each other, the second surface 122*a* of the plate-shaped magnetic body 120*a* of the first toy block 100 is seated on the base surface 111, and the second surface 222*a* of the plate-shaped magnetic body 220*a* of the second toy block 200 is seated on the base surface 211. In this case, the second surface 122*a* of the plate-shaped magnetic body 120*a* of the first toy block 100 may face the second surface 222*a* of the plate-shaped magnetic body 220*a* of the second toy block 200 in parallel, and the magnetic attraction between the plate-shaped magnetic body 120*a* of the first toy block 100 and the plate-shaped magnetic body 220*a* of the second toy block 200 may be maximized. Accordingly, one side of the first toy block 100 and the other side of the second toy block 200 may be strongly coupled to each other.

Meanwhile, when the main guide 131*a* and the sub guide 132*a* do not exist, since the rotation of the plate-shaped magnetic body 120*a* may not be guided, the second surface 122*a* of the plate-shaped magnetic body 120*a* may not be stably seated on the base surface 111, and the second surface 122*a* of the plate-shaped magnetic body 120*a* may be incorrectly disposed on the base surface 111 or separated from the base surface 111. For a detailed description of the above, FIG. 6 will be referenced.

Figure 6:
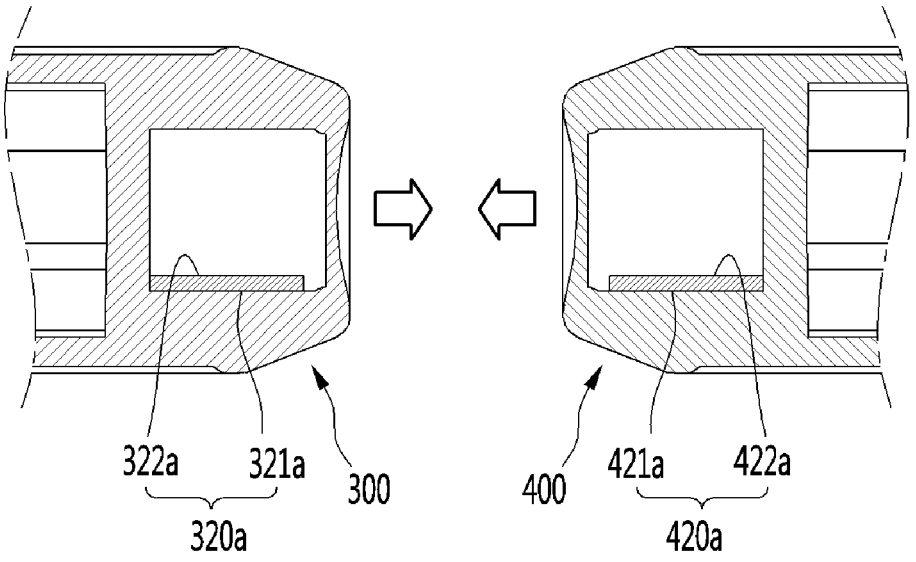
FIG. 6 is a use state view of toy blocks according to Comparative examples.

FIG. 6 is a use state view of toy blocks according to Comparative examples.

Referring to FIG. 6, each of a first toy block 300 and a second toy block 400 does not have a main guide and a sub guide. When a second surface 322*a* of a plate-shaped magnetic body 320*a* of the first toy block 300 has a polarity different from a polarity of a second surface 422*a* of a plate-shaped magnetic body 420*a* of the second toy block 400, since the first toy block 300 and the second toy block 400 become close to each other, magnetic attraction acts between the second surface 322*a* of the plate-shaped magnetic body 320*a* of the first toy block 300 and the second surface 422*a* of the plate-shaped magnetic body 420*a* of the second toy block 400.

However, since the first toy block 300 and the second toy block 400 do not have the main guides and the sub guides configured to guide rotation of the plate-shaped magnetic bodies 320*a* and 420*a*, as shown in FIG. 6, the plate-shaped magnetic bodies 320*a* and 420*a* may not completely rotate. In this case, the second surface 322*a* of the plate-shaped magnetic body 320*a* of the first toy block 300 and the second surface 422*a* of the plate-shaped magnetic body 420*a* of the second toy block 400 may not face each other in parallel, and the magnetic attraction between the plate-shaped magnetic bodies 320*a* and 420*a* may not be maximized. Accordingly, the first toy block 300 and the second toy block 400 may be weakly coupled to each other.

Further, when guide parts are not provided, since the plate-shaped magnetic bodies 320*a* and 420*a* are not stably seated on base surfaces, the first toy block 300 and the second toy block 400 may be incorrectly coupled to each other.

However, as described above, since the toy blocks 100 and 200 according to the embodiment of the present disclosure include the guide parts configured to guide the rotation of the plate-shaped magnetic bodies 120*a* and 220*a*, the first surfaces 121*a* and 221*a* or the second surfaces 122*a* and 222*a* of the plate-shaped magnetic bodies 120*a* and 220*a* may be stably seated on the base surfaces 111 and 211, and the surfaces of the plate-shaped magnetic bodies 120*a* and 220*a* may face each other in parallel. Accordingly, a magnetic force between the plate-shaped magnetic bodies 120*a* and 220*a* may be maximized, and the toy blocks 100 and 200 may be more easily coupled to each other.

Further, since the base surfaces 111 and 211 of the toy blocks 100 and 200 according to the embodiment of the present disclosure have sizes which are substantially the same as those of the first surfaces 121*a* and 221*a* or the second surfaces 122*a* and 222*a* of the plate-shaped magnetic bodies 120*a* and 220*a*, the first surfaces 121*a* and 221*a* or the second surfaces 122*a* and 222*a* may substantially cover all of the base surfaces 111 and 211, and the magnetic lines of the plate-shaped magnetic bodies 120*a* and 220*a* may be further concentrated to the base surfaces 111 and 211. Accordingly, a problem in which the toy blocks 100 and 200 are incorrectly coupled to each other may be further restricted.

Figure 7:
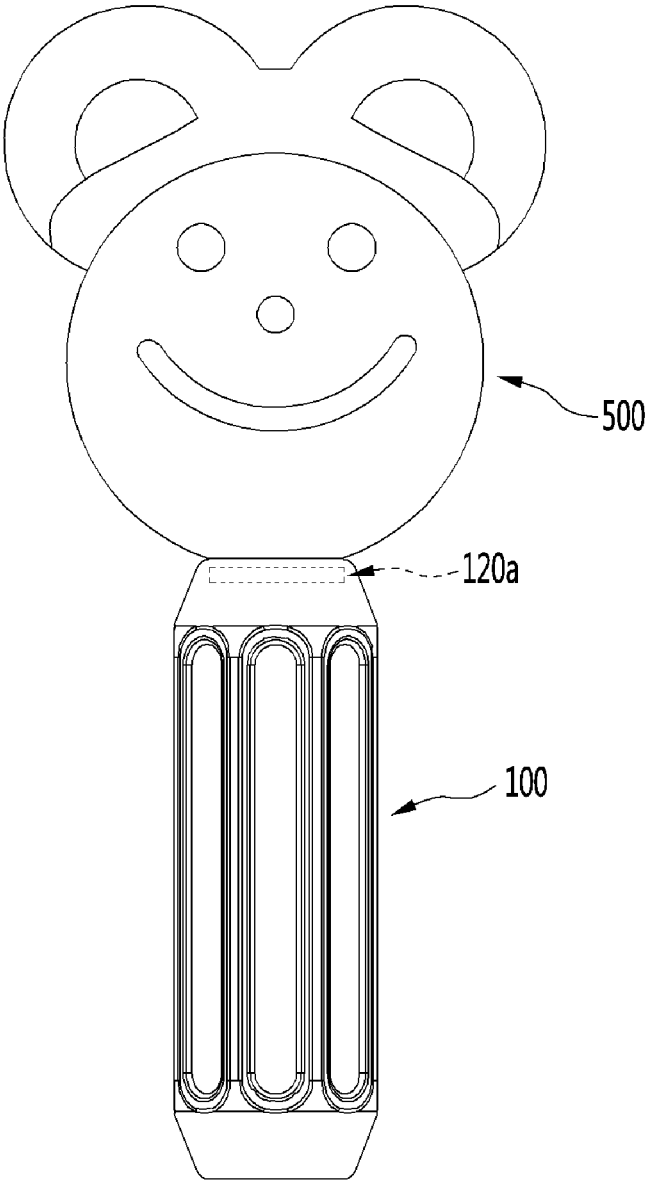
FIG. 7 is another use state view of a toy block according to an embodiment of the present disclosure.

FIG. 7 is another use state view of the toy block according to the embodiment of the present disclosure.

The toy block 100 according to the embodiment of the present disclosure may also be easily coupled to another toy block 500 having various shapes. In this case, the other toy block 500 may be formed of a magnetic body having a magnetic force by a magnetic field such as metal. That is, since the toy block 100 including the plate-shaped magnetic body 120*a* formed of a permanent magnet approaches the other toy block 500, the other toy block 500 has magnetism, and since a polarity different from the polarity of the plate-shaped magnetic body 120*a* is induced on a surface of the other toy block 500, the other toy block 500 and the toy block 100 may be coupled to each other.

Particularly, since the toy block 100 and the other toy block 500 are coupled by the magnetic force without a separate engaging member, the exterior of the toy block 100 may be varied, and as shown in FIG. 7, the spherical-shaped other toy block 500 and the pillar-shaped toy block 100 may be stably assembled without a separate engaging member. Accordingly, the above may be greatly helpful to improve ingenuity of users using the toy block 100.

According to one of the above-described technical solutions of the present disclosure, a separate engaging member is not necessary to be provided to couple toy blocks and shapes of the toy blocks can be varied.

Further, according to one of the technical solutions of the present disclosure, since rotation of a plate-shaped magnetic body is guided by a guide part, the plate-shaped magnetic body can be stably seated on a base surface, and a problem in which the toy blocks are dislocated when coupled to each other can be minimized.

Effects which may be gained from the present disclosure are not limited to the above-described effects and unmentioned effects may be apparently understood by those skilled in the art from disclosures which will be described below.

The above description of the present disclosure is exemplary, and it may be understood by those skilled in the art that the present disclosure may be easily modified into other specific forms without changing the technical spirit or essential characteristics. Accordingly, the above-described embodiment should be understood to be wholly exemplary and not limited. For example, elements described as a single type may be implemented to be divided, and elements described as being divided may be implemented as a coupled type.

The scope of the present disclosure will be shown by the appended claims rather than the detailed description, and all changeable or modifiable shapes derived from meanings and scope of the claims and equivalents of the above should be considered to be within the scope of the present disclosure.

What is claimed is:

1. A toy block comprising:

a main body including a base surface at one side of the main body and an accommodation space formed to surround the base surface;

a plate-shaped magnetic body disposed in the accommodation space and including a first surface and a second surface having different polarities; and a guide part disposed in the accommodation space and configured to guide rotation of the plate-shaped magnetic body, wherein the first surface or the second surface of the plate-shaped magnetic body is seated on the base surface;

wherein the guide part comprises a main guide protruded from an inner surface of the accommodation space in a predetermined direction, and a sub guide protruded from the inner surface of the accommodation space;

wherein the main guide is configured to correspond to an outer shape of the plate-shaped magnetic body when the plate-shaped magnetic body rotates, the main guide forming an arch shape with respect to the base surface.

2. The toy block of claim 1, wherein the main guide and the sub guide extend in directions perpendicular to each other.

3. The toy block of claim 1, wherein the base surface corresponds to a size of the first surface or the second surface of the plate-shaped magnetic body.

4. The toy block of claim 1, wherein each of the first surface and the second surface of the plate-shaped magnetic body has a circular shape.

* * * * *